US009084321B2

(12) United States Patent
Cao

(10) Patent No.: US 9,084,321 B2
(45) Date of Patent: Jul. 14, 2015

(54) LED BACKLIGHT SYSTEM AND DISPLAY DEVICE

(71) Applicant: Shenzhen China Star Optoelectronics Technology Co., Ltd., Shenzhen, Guangdong (CN)

(72) Inventor: Dan Cao, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 136 days.

(21) Appl. No.: 14/006,091

(22) PCT Filed: Jul. 19, 2013

(86) PCT No.: PCT/CN2013/079650
§ 371 (c)(1),
(2) Date: Sep. 18, 2013

(87) PCT Pub. No.: WO2015/006963
PCT Pub. Date: Jan. 22, 2015

(65) Prior Publication Data

US 2015/0015148 A1 Jan. 15, 2015

(30) Foreign Application Priority Data

Jul. 15, 2013 (CN) ..... 2013 1 02960129

(51) Int. Cl.
*H05B 33/08* (2006.01)

(52) U.S. Cl.
CPC ..... *H05B 33/0815* (2013.01)

(58) Field of Classification Search
USPC ..... 315/246, 247, 224, 225, 209 R, 291, 315/307–326
See application file for complete search history.

(56) References Cited

U.S. PATENT DOCUMENTS

2014/0354180 A1* 12/2014 Zhang et al. ..... 315/307
2014/0354186 A1* 12/2014 Sun et al. ..... 315/310

* cited by examiner

*Primary Examiner* — Tuyet Vo
(74) *Attorney, Agent, or Firm* — Andrew C. Cheng

(57) ABSTRACT

The present invention discloses an LED backlight system and a display device. The LED backlight system includes an LED display module and an LED backlight control circuit. The LED display module includes LED string. The LED backlight control circuit includes a current module, a comparison unit, a control switch unit, and an impedance unit wherein, an input terminal of the comparison unit obtains a voltage at a negative terminal of the LED string, and when the voltage at the negative terminal is greater than a preset threshold voltage, the comparison unit controls the control switch unit to turn on such that the impedance unit connects in parallel with the current module so as to decrease the voltage at the negative terminal. Through above way, the present invention can prevent the unstability of the circuit loop in order to prevent the flicker phenomenon of the backlight system.

20 Claims, 2 Drawing Sheets

LED BACKLIGHT SYSTEM AND DISPLAY DEVICE

BACKGROUND OF THE INVENTION

1. Field of the Invention

The present invention relates to a display, and more particularly to an LED backlight system and a display device.

2. Description of Related Art

At present, the conventional LED backlight system includes LED strings and an LED backlight control circuit for controlling the LED strings, wherein, the LED backlight control circuit mainly control turning on and off of the LED strings. However, when the LED strings are turned on, because the internal resistances of the LED strings are not identical, it easily causes a voltage difference between the LED strings. And when the voltage difference is too large, it will cause the unstability of the circuit loop in order to generate flicker phenomenon in the LED backlight system.

Therefore, it is desirable to provide a technical solution to solve the above technical problems.

SUMMARY OF THE INVENTION

The main object of the present invention is to provide is to provide an LED backlight system and a display device to prevent, the unstability of the circuit loop because the voltage difference of the LED strings is too large so as to prevent flicker phenomenon of the LED backlight system.

In order to solve the above technical problems, a technical solution provided by the present invention is: an LED backlight system comprising: a power module for providing a power source; an LED display module connected to the power module and including a plurality of LED strings connected in parallel; and an LED backlight control circuit including: a plurality of current modules having the same number as the LED strings and electrically connecting to the corresponding LED strings to provide working currents for the LED strings; and a plurality of control modules having the same number as the LED strings and each of the control modules includes a comparison unit, a control switch unit connected to the comparison unit, and an impedance unit connected to control switch unit, wherein, an input terminal of the comparison unit obtains a voltage at a negative terminal of the LED string, and when the voltage at the negative terminal is greater than a preset threshold voltage, the comparison unit outputs a control signal to control the control switch unit to turn on such that the impedance unit connects in parallel with the current module so as to increase the working current of the LED string in order to decrease the voltage at the negative terminal; wherein, the power module includes an inductor and a diode, wherein a positive terminal of the diode connects to the inductor, and a negative terminal of the diode connects to positive terminals of the LED strings; and the comparison unit is a comparator, the control switch unit is a first switch, and the impedance unit is an adjustable resistor, wherein a first input terminal of the comparator connects to the negative terminal of the LED string; a second input terminal of the comparator receives the preset threshold voltage; an output terminal of the comparator outputs the control signal, and a gate electrode of the first switch connects to the output of the comparator; a source electrode of the first switch connects to one end of the current module, and the other end of the current module connects to one end of the adjustable resistor, and the other end of the adjustable resistor connects to a drain electrode of the first switch.

Wherein, the LED backlight control circuit further includes multiple display switch modules having the same number as the LED strings, and the display switch modules are disposed between the LED strings and the current modules, wherein, the display switch modules are second switches which are connected in series with the LED strings, and the second switches receive LED-string-switch-control-PWM-dimming signals for controlling turning on and off of the LED strings.

In order to solve the above technical problems, another technical solution provided by the present invention is: an LED backlight system comprising: a power module for providing a power source; an LED display module connected to the power module and including a plurality of LED strings connected in parallel; and an LED backlight control circuit including: a plurality of current modules having the same number as the LED strings and electrically connecting to the corresponding LED strings to provide working currents for the LED strings; and a plurality of control modules having the same number as the LED strings and each of the control modules includes a comparison unit, a control switch unit connected to the comparison unit, and an impedance unit connected to control switch unit; wherein, an input terminal of the comparison unit obtains a voltage at a negative terminal of the LED string, and when the voltage at the negative terminal is greater than a preset threshold voltage, the comparison unit outputs a control signal to control the control switch unit to turn on such that the impedance unit connects in parallel with the current module so as to increase the working current of the LED string in order to decrease the voltage at the negative terminal.

Wherein, the comparison unit is a comparator, and a first input terminal of the comparator connects to the negative terminal of the LED string, and a second input terminal of the comparator receives the preset threshold voltage, and an output terminal of the comparator outputs the control signal.

Wherein, the control switch unit is a first switch, and the impedance unit is an adjustable resistor, wherein a gate electrode of the first switch connects to the output of the comparator, and a source electrode of the first switch connects to one end of the current module, and the other end of the current module connects to one end of the adjustable resistor, and the other end of the adjustable resistor connects to a drain electrode of the first switch.

Wherein, the LED backlight control circuit further includes multiple display switch modules having the same number as the LED strings, and the display switch modules are disposed between the LED strings and the current modules, wherein, the display switch modules are second switches which are connected in series with the LED strings, and the second switches receive LED-string-switch-control-PWM-dimming signals for controlling turning on and off of the LED strings.

Wherein, the LED backlight control circuit further includes a processing module for providing the LED-string-switch-control-PWM-dimming signals to the second switches, and the processing module further provides fixed working voltages to the current modules.

Wherein, gate electrodes of the second switches electrically connect to the processing module; source electrodes of the second switches electrically connect to the current modules; drain electrodes of the second switches connect to the negative terminals of the LED strings.

Wherein, the current modules are fixed value resistors, and one end of each fixed value resistor connects to the source electrode of the second switch, and the other end of each fixed value resistor connects to the source electrode of the first switch.

Wherein, the first switches and the second switches are MOS transistors for dimming.

Wherein, the power module includes an inductor and a diode, wherein a positive terminal of the diode connects to the inductor, and a negative terminal of the diode connects to positive terminals of the LED strings.

In order to solve the above technical problems, another technical solution provided by the present invention is: a display device includes a display panel and an LED backlight system for providing a backlight for the display panel, wherein, the LED backlight system comprises: a power module for providing a power source; an LED display module connected to the power module and including a plurality of LED stings connected in parallel; and an LED backlight control circuit including: a plurality of current modules having the same number as the LED strings and electrically connecting to the corresponding LED strings to provide working currents for the LED strings; and a plurality of control modules having the same number as the LED strings, and each of the control modules includes a comparison unit, a control switch unit connected to the comparison unit, and an impedance unit connected to control switch unit; wherein, an input terminal of the comparison unit obtains a voltage at a negative terminal of the LED string, and when the voltage at the negative terminal is greater than a preset threshold voltage, the comparison unit outputs a control signal to control the control switch unit to turn on such that the impedance unit connects in parallel with the current module so as to increase the working current of the LED string in order to decrease the voltage at the negative terminal.

Wherein, the comparison unit is a comparator, and a first input terminal of the comparator connects to the negative terminal of the LED string, and a second input terminal of the comparator receives the preset threshold voltage, and an output terminal of the comparator outputs the control signal.

Wherein, the control switch unit is a first switch, and the impedance unit is an adjustable resistor, wherein a gate electrode of the first switch connects to the output of the comparator, and a source electrode of the first switch connects to one end of the current module, and the other end of the current module connects to one end of the adjustable resistor, and the other end of the adjustable resistor connects to a drain electrode of the first switch.

Wherein, the LED backlight control circuit further includes multiple display switch modules having the same number as the LED strings, and the display switch modules are disposed between the LED strings and the current modules, wherein, the display switch modules are second switches which are connected in series with the LED strings, and the second switches receive LED-string-switch-control-PWM-dimming signals for controlling turning on and off of the LED strings.

Wherein, the LED backlight control circuit further includes a processing module for providing the LED-string-switch-control-PWM-dimming signals to the second switches, and the processing module further provides fixed working voltages to the current modules.

Wherein, gate electrodes of the second switches electrically connect to the processing module; source electrodes of the second switches electrically connect to the current modules; drain electrodes of the second switches connect to the negative terminals of the LED strings.

Wherein, the current modules are fixed value resistors, and one end of each fixed value resistor connects to the source electrode of the second switch, and the other end of each fixed value resistor connects to the source electrode of the first switch.

Wherein, the first switches and the second switches are MOS transistors for dimming.

Wherein, the power module includes an inductor and a diode, wherein a positive terminal of the diode connects to the inductor, and a negative terminal of the diode connects to positive terminals of the LED strings.

The beneficial effects of the present invention are: comparing to the conventional art, the present invention disposes the control modules having the same number as the LED strings in the LED backlight control circuit. Each of the control modules includes a comparison unit, a control switch unit connected to the comparison unit, and an impedance unit connected to control switch unit, wherein, an input terminal of the comparison unit obtains a voltage at a negative terminal of the LED string, and when the voltage at the negative terminal is greater than a preset threshold voltage, the comparison unit outputs a control signal to control the control switch unit to turn on such that, the impedance unit connects in parallel with the current module so as to increase the working current of the LED string in order to decrease the voltage at the negative terminal. Through the above way, when the voltage difference between the LED strings is larger, and the voltage at the negative terminal of at least one of the LED strings is higher than the threshold voltage, through connecting the impedance unit in parallel to increase the working current of the LED string in order to decrease the voltage at the negative terminal of the LED string. Therefore, it can prevent generating the unstability of the circuit loop in order to prevent flicker phenomenon. Secondly, because it can timely adjust the voltage at the negative terminal of the LED string, it can reduce the optical requirement for the LED strings so as to reduce the cost.

DETAILED DESCRIPTION OF THE PREFERRED EMBODIMENT

The following content combines with the drawings and the embodiment for describing the present invention in detail.

Figure 1:
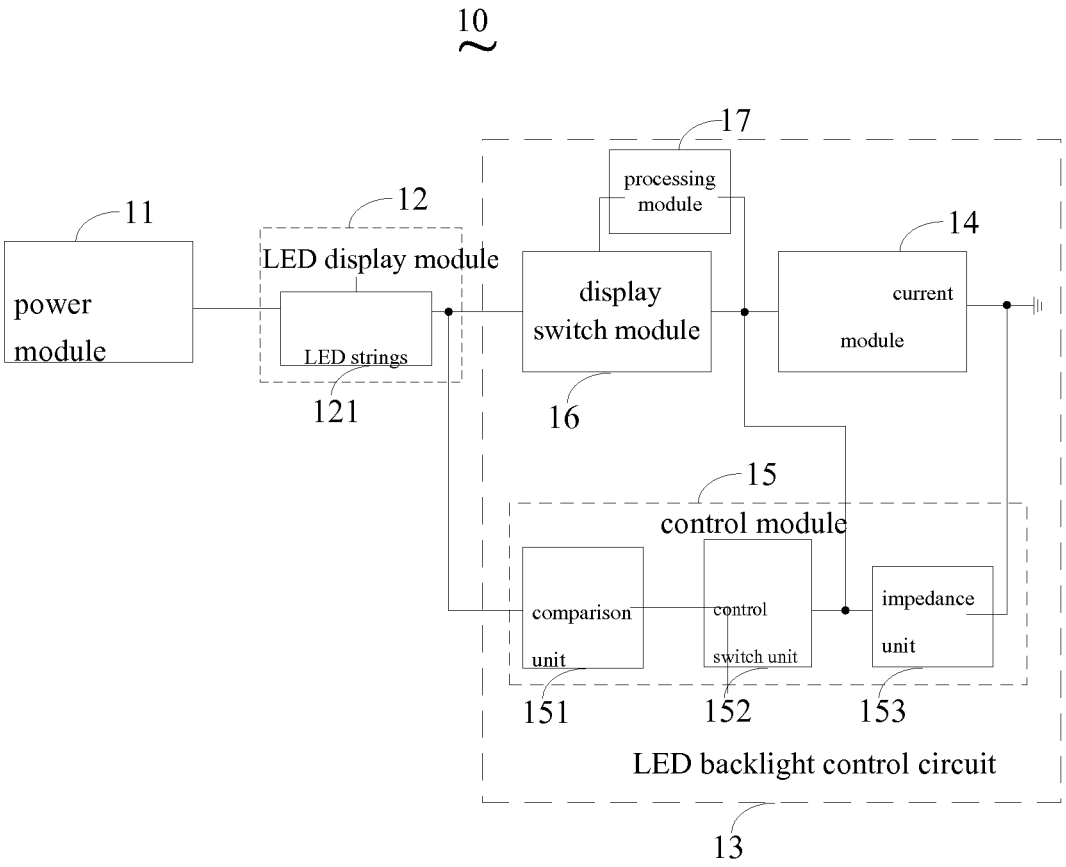
FIG. 1 is a schematic block diagram of an LED back light system according to an embodiment of the present invention.

With reference to FIG. 1, it is a schematic block diagram of an LED backlight system according to an embodiment of the present invention. As shown in FIG. 1, the backlight system 10 of the present invention includes a power module 11, an LED display module 12, and an LED backlight control circuit 13.

Wherein, the LED display module 12 electrically connects to the power module 11 and LED backlight control circuit 13 respectively. The power module 11 is for providing a power source. The LED display module 12 includes a plurality of LED strings 121 connected in parallel. The LED backlight control circuit 13 is for controlling the display of the LED strings 121.

In this embodiment, the LED backlight control circuit 13 includes a plurality of current modules 14 and control modules 15, and each of both has the same number as the LED strings 121. Wherein, the current modules 14 electrically connect to the corresponding LED strings 121 to provide working currents for the LED strings 121. The control modules 15 operate with the current modules 114 to control the working currents of the LED strings 121.

Specifically, each of the control modules 15 includes a comparison unit 151, a control switch unit 152 connected to the comparison unit 151, and an impedance unit 153 connected to control switch unit 152. Wherein, an input terminal of the comparison unit 151 obtains a voltage at a negative terminal of the LED string 121. And when the voltage at the negative terminal of the LED string 121 is greater than a preset threshold voltage, the comparison unit 151 outputs a control signal to control the control switch unit 152 to turn on such that the impedance unit 153 connects in parallel with the current module 14 so as to increase the working current of the LED string 121 in order to decrease the voltage at the negative terminal of the LED string 121.

In this embodiment, the LED backlight control circuit 13 further includes a processing nodule 17 and multiple display switch modules 16 having the same number as the LED strings 121. Wherein, the display switch modules 16 are disposed between the LED strings 121 and the current modules 14 for turning on and of the LED strings 121. The processing module 17 provides LED-string-switch-control-PWM-dimming signals (PWM Dimming signal, referred as PDIM signal) for controlling turning on and off of the LED strings 121 to the display switch module 16, and further provides a fixed working voltage to the current modules 14.

Accordingly, through the LED backlight control circuit 13 of the present invention, when the voltage difference between the plurality of LED strings 121 is larger, and the voltage at the negative terminal of at least one of the LED strings 121 is greater than the threshold voltage, it timely connects the impedance unit 153 in parallel, that is, reducing the impedance to increase the working current of the LED string 121. Thereby, it can reduce the voltage at the negative terminal of the LED string 121, prevent unstable circuit loop because of the too large voltage difference of the LED strings 121, and prevent flicker phenomenon of the LED backlight system 10. Secondly, because it can timely adjust the voltage at the negative terminal of the LED string 121, it can reduce the optical requirement for the LED strings 121 so as to reduce the cost.

Figure 2:
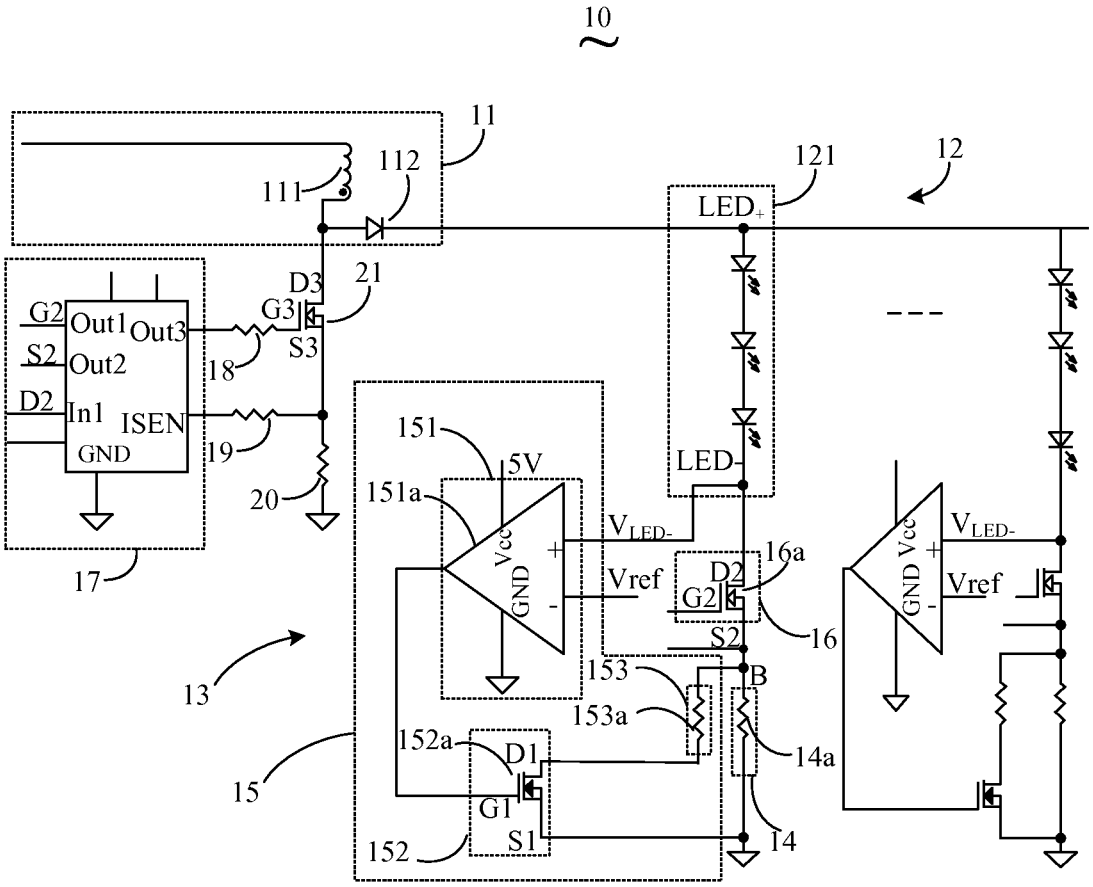
FIG. 2 is a specific diagram of the LED backlight system shown in FIG. 1.

With reference to FIG. 2, it is a specific diagram of the LED backlight system shown in FIG. 1. As shown in FIG. 2, the LED strings 121 electrically connect to the power module 11 and the LED backlight control circuits 13 form circuit loops. There are multiple circuit loops because there are multiple LED strings 121. The connection method and working principle of each circuit loop is the same, the following example illustrates the connection method and working principle for only one circuit loop.

In this embodiment, the comparison unit 151 is a comparator 151*a*. A first input terminal of the comparator 151*a* connects to a negative terminal LED− of the LED string 121 to obtain a voltage $V_{LED-}$ at the negative terminal LED−. A second input terminal of the comparator 151*a* receives a preset threshold voltage $V_{ref}$. An output terminal, of the comparator 151*a* outputs a control signal. Wherein, the comparator 151*a* also connects respectively with 5 v DC voltage and a ground voltage.

The control switch unit 152 is a first switch 152*a*, and the impedance unit 153 is an adjustable resistor 153*a*. Wherein, a gate electrode G1 of the first switch 152*a* connects to the output of the comparator 151*a*. A source electrode S1 of the first switch 152*a* connects to one end of the current module 14. The other end of the current module 14 connects to one end of the adjustable resistor 153*a*. The other end of the adjustable resistor 153*a* connects to a drain electrode D1 of the first switch 152*a*.

The display switch module 16 is a second switch 16*a* which is connected in series with the LED string 121. The second switch 16*a* receives the LED-string-PWM-dimming signal for controlling turning on and off of the LED string 121. Specifically, a gate electrode G2 of the second switch 16*a* electrically connects to the processing module 17; a source electrode S2 of the second switch 16*a* connects to the current module 14; a drain electrode D2 of the second switch 16*a* connects to the negative terminal LED− of the LED string 121. The current module 114 is a fixed value resistor 114*a*, wherein one end of the fixed value resistor 14*a* respectively connects to the source electrode 52 of the second switch 16*a* and the adjustable resistor 153*a*, and the other end of the resistor 14*a* respectively connects to the source electrode S1 of the first switch 152*a* and the ground.

The processing module 17 includes a plurality of input and output terminals. Wherein, a first input terminal In1 electrically connects between a connection node of the first input terminal of the comparator 151*a* and the negative terminal LED− of the LED string 121 and the drain electrode D2 of the second switch 16*a* to receive the voltage $V_{LED-}$ at the negative terminal LED−.

A first output terminal Out1 electrically connects to a gate electrode G2 of the second switch 16*a* for providing the LED-string-switch-control-PWM-dimming signal to the gate electrode G2. A second output terminal Out2 electrically connects between a connection node 13 of the fixed value resistor 14*a* and the adjustable resistor 153*a* and the source electrode S2 of the second switch 16*a* to provide a fixed working voltage $V_B$ to the fixed value resistor 14*a*.

The power module 11 includes an inductor 111 and a diode 112. Wherein a positive terminal of the diode 112 connects to the inductor 111, a negative terminal of the diode 112 connects to a positive terminal LED+ of the LED string 121.

In this embodiment, the LED backlight control circuit 13 further includes a switch resistor 18, sense resistors 19 and 20, and a third switch 21. Wherein, one end of the sense resistor 19 connects to a current sense terminal ISEN of the processing module 17, the other end of the sense resistor 19 connects to one end of the sense resistor 20, and the other end of the sense resistor 20 connects to the ground. A gate electrode G3 of the third switch 21 connects to one end of the switch resistance 18. A drain electrode D3 of the third switch 21 connects to the positive terminal of the diode D3. A source electrode S3 of the third switch 21 connects to one end of the sense resistor 20. The other end of the switch resistor 18 connects to a third output terminal Out3 of the processing module 17 to receive a switching control signal provided by the processing module 17.

In this embodiment, the first switch 152*a* and the second switch 16*a* are MOS transistors for dimming.

The following will illustrate the working principle of the LED backlight system 10. Because the working principle of each LED string 121 is the same, therefore, it only illustrates the working principle for one LED string 121, specifically. When the switching control signal which is provided from the third output terminal Out3 of the processing module 17 to the gate electrode G3 of the third switch 21 is a high voltage, the third switch 21 is turned on. The inductor 111 stores the current energy, and the diode 112 prevents the current from reversing. When the switching control signal which is provided from the third output terminal Out3 of the processing module 17 to the gate G3 of the third switch 21 is a low voltage, the third switch 21 is turned off. At this time, the current stored in the inductor 111 outputs from the inductor 111 to the LED string 121 through the diode 112.

When the LED-string-switching-control-PWM-dimming signal which is provided by the processing module 17 received by the gate electrode G2 of the second switch 16*a* is a high voltage, the second switch 16*a* is turned on. The LED string 121 begins to display. At this time, the processing module 17 further provides a fixed working voltage $V_B$ to the fixed value resistor 14*a*.

The first input terminal of the comparator 151*a* receives voltage $V_{LED-}$ at the negative terminal of the LED string 121. And the comparator 151*a* compares the $V_{LED-}$ with the preset threshold voltage $V_{ref}$. When the $V_{LED-}$ is less than $V_{ref}$, the comparator 151*a* outputs a low voltage signal to control the first switch 152*a* to turn off. At this time, the working current in the LED light string 121 is $I=V_B/R_{14a}$, wherein, $R_{14a}$ is the resistance of the fixed value resistor 14*a*.

When the voltage difference between the LED strings 121 is larger and the voltage $V_{LED-}$ at the negative terminal LED− of one of the LED strings 121 is greater than the threshold voltage $V_{ref}$, the comparator 151*a* outputs a high voltage signal to control the first switch 152*a* to turn on such that it controls the adjustable resistor 153*a* to connect into the circuit and to be connected in parallel with the fixed value resistor 14*a*. At this time, the working current in the LED string 121 is $I'=V_B*(R_{153a}+R_{14a})/(R_{153a}*R_{14a})$ wherein, $R_{153a}$ is the current resistance of the adjustable resistor 153*a*. In this embodiment, it is preferred to connect the first maximum value of the adjustable resistor 153*a* into the circuit.

From operation formulas of the above two working current, it can obtain that I' is greater than I. That is, when the voltage $V_{LED-}$ at the negative terminal of the LED string 121 is increased, LED backlight control circuit 13 increases the working current of the LED string 121. And according to the current characteristic of the LED string 121, when the current of the LED light string 121 is increased, the voltage drop of the LED string 121 will be increased. However, the voltage at the positive terminal LED of the LED string 121 is constant, so that it can reduce the voltage $V_{LED-}$, at the negative terminal LED− of the LED string 121 in order to prevent generating the unstability of the circuit loop.

In this embodiment, it further controls the voltage $V_{LED-}$ at the negative terminal of the LED light string 121*b* adjusting the adjustable resistor 153*a* such that the voltage $V_{LED-}$ at the negative terminal LED− is slightly higher than the threshold voltage $V_{ref}$. On one hand, it ensures that the comparator to 151*a* outputs a high voltage signal to control the adjustable resistor 153*a* to be in parallel with the fixed value resistor 14*a*, and on the other hand, it allows that the voltage $V_{LED-}$ sensed by the processing module 17 from the negative terminal LED− is within the specification of the processing module 17 to prevent generating the unstability of the circuit loop in order to prevent the flicker phenomenon of the LED backlight system 10.

In this embodiment, the conduction frequency and the conduction time of the second switch 16*a* are the same with the frequency and pulse width of the LED-string-switch-control-PWM-dimming signal.

Figure 3:
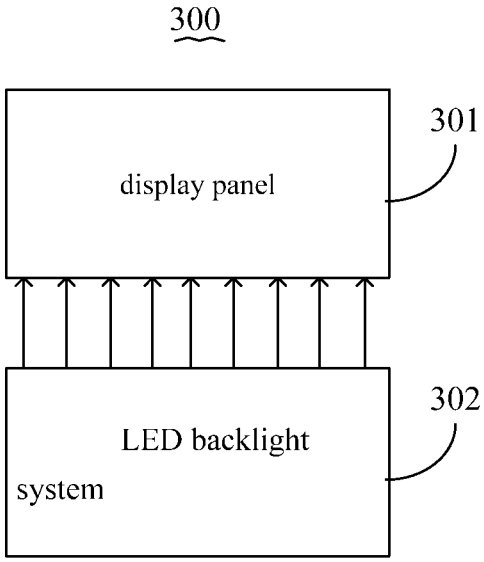
FIG. 3 is a schematic block diagram of a display device according to an embodiment of present invention.

With reference to FIG. 3, it is a schematic block diagram of a display device according to an embodiment of present invention. As shown in FIG. 3, a display device 300 of the present invention includes a display panel 301 and an LED backlight system 302 for providing the backlight for the display panel 301. Wherein, the LED backlight system 302 is the LED backlight system 10 as mentioned previously, and it does not discuss here again.

In summary, the present invention, disposes the control modules 15 having the same number as the LED strings 121 in the LED backlight control circuit 13. When the voltage difference between the LED strings 121 is larger, and the voltage $V_{LED-}$ at the negative terminal LED− of one of the LED strings 121 is higher than the threshold voltage through the first switch 152*a* such that the adjustable resistor 153*a* and the fixed value resistor 14*a* are connected in parallel to increase the working current of the LED string 121 on order to decrease the voltage $V_{LED-}$ at the negative terminal LED− of the LED string 121. On one hand, it can prevent generating the unstability of the circuit loop in order to prevent flicker phenomenon. On the other hand, because it can timely adjust the voltage at the negative terminal LED− of the LED string 121, it can reduce the optical requirement for the LED strings 121 so as to reduce the cost.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. An LED backlight system comprising:

a power module for providing a power source;

an LED display module connected to the power module and including a plurality of LED strings connected in parallel; and an LED backlight control circuit including:

a plurality of current modules having the same number as the LED strings and electrically connecting to the corresponding LED strings to provide working currents for the LED strings; and a plurality of control modules having the same number as the LED strings and each of the control modules includes a comparison unit, a control switch unit connected to the comparison unit, and an impedance unit connected to control switch unit, wherein, an input terminal of the comparison unit obtains a voltage at a negative terminal of the LED string, and when the voltage at the negative terminal is greater than a preset threshold voltage, the comparison unit outputs a control signal to control the control switch unit to turn on such that the impedance unit connects in parallel with the current module so as to increase the working current of the LED string in order to decrease the voltage at the negative terminal;

wherein, the power module includes an inductor and a diode, wherein a positive, terminal of the diode connects to the inductor, and a negative terminal of the diode connects to positive terminals of the LED strings; and the comparison unit is a comparator, the control switch unit is a first switch, and the impedance unit is an adjustable resistor, wherein a first input terminal of the comparator connects to the negative terminal of the LED string; a second input terminal of the comparator receives the preset threshold voltage; an output terminal of the comparator outputs the control signal, and a gate electrode of the first switch connects to the output of the comparator; a source electrode of the first switch connects to one end of the current module, and the other end of the current module connects to one end of the adjustable resistor, and the other end of the adjustable resistor connects to a drain electrode of the first switch.

2. The LED backlight system according to claim 1, wherein, the LED backlight control circuit further includes multiple display switch modules having the same number as the LED strings, and the display switch modules are disposed between the LED strings and the current modules, wherein, the display switch modules are second switches which are connected in series with the LED strings, and the second switches receive LED-string-switch-control-PWM-dimming signals for controlling turning on and off of the LED strings.

3. An LED backlight system comprising:

a power module for providing a power source;

an LED display module connected to the power module and including a plurality of LED strings connected in parallel; and an LED backlight control circuit including:

a plurality of current modules having the same number as the LED strings and electrically connecting to the corresponding LED strings to provide working currents for the LED strings; and a plurality of control modules having the same number as the LED strings and each of the control modules includes a comparison unit, a control switch unit connected to the comparison unit, and an impedance unit connected to control switch unit;

wherein, an input terminal of the comparison unit obtains a voltage at a negative, terminal of the LED string, and when the voltage at the negative terminal is greater than a preset threshold voltage, the comparison unit outputs a control signal to control the control switch unit to turn on such that the impedance unit connects in parallel with the current module so as to increase the working current of the LED string in order to decrease the voltage at the negative terminal.

4. The LED backlight system according to claim 3, wherein, the comparison unit is a comparator, and a first input terminal of the comparator connects to the negative terminal of the LED string, and a second input terminal of the comparator receives the preset threshold voltage, and an output terminal of the comparator outputs the control signal.

5. The LED backlight system according to claim 4, wherein, the control switch unit is a first switch, and the impedance unit is an adjustable resistor, wherein a gate electrode of the first switch connects to the output of the comparator, and a source electrode of the first switch connects to one end of the rent module, and the other end of the current module connects to one end of the adjustable resistor, and the other end of the adjustable resistor connects to a drain electrode of the first switch.

6. The LED backlight system according to claim 5, wherein, the LED backlight control circuit further includes multiple display switch modules having the same number as the LED strings, and the display switch modules are disposed between the LED strings and the current modules, wherein, the display switch modules are second switches which are connected in series with the LED strings, and the second switches receive LED-string-switch-control-PWM-dimming signals for controlling turning on and off of the LED strings.

7. The LED backlight system according to claim 6, wherein, the LED backlight control circuit further includes a processing module for providing the LED-string-switch-control-PWM-dimming signals to the second switches, and the processing module further provides fixed working voltages to the current modules.

8. The LED backlight system according to claim 7, wherein, gate electrodes of the second switches electrically connect to the processing module; source electrodes of the second switches electrically connect to the current modules; drain electrodes of the second switches connect to the negative terminals of the LED strings.

9. The LED backlight system according to claim 8, wherein, the current modules are fixed value resistors, and one end of each fixed value resistor connects to the source electrode of the second switch and the other end of each fixed value resistor connects to the source electrode of the first switch.

10. The LED backlight system according to claim 8, wherein, the first switches and the second switches are MOS transistors for dimming.

11. The LED backlight system according to claim 3, wherein, the power module includes an inductor and a diode, wherein a positive terminal of the diode connects to the inductor and a negative terminal of the diode connects to positive terminals of the LED strings.

12. A display device includes a display panel and an LED backlight system for providing a backlight for the display panel, wherein, the LED backlight system comprises:

a power module for providing a power source;

an LED display module connected to the power module and including a plurality of LED strings connected in parallel; and an LED backlight control circuit including:

a plurality of current nodules having the same number as the LED strings and electrically connecting to the corresponding LED strings to provide working currents for the LED strings; and a plurality of control modules having the same number as the LED strings, and each of the control modules includes a comparison unit, a control switch unit connected to the comparison unit, and an impedance unit connected to control switch unit;

wherein, an input terminal of the comparison unit obtains a voltage at a negative terminal of the LED string, and when the voltage at the negative terminal is greater than a preset threshold voltage, the comparison unit outputs a control signal to control the control switch unit to turn on such that the impedance unit connects in parallel with the current module so as to increase the working current of the LED string in order to decrease the voltage at the negative terminal.

13. The display device according to claim 12, wherein, the comparison unit is a comparator, and a first input terminal of the comparator connects to the negative terminal of the LED string, and a second input terminal of the comparator receives the preset threshold voltage, and an output terminal of the comparator outputs the control signal.

14. The display device according to claim 13, wherein, the control switch unit is a first switch, and the impedance unit is an adjustable resistor, wherein a gate electrode of the first switch connects to the output of the comparator, and a source electrode of the first switch connects to one end of the current module, and the other end of the current module connects to one end of the adjustable resistor, and the other end of the adjustable resistor connects to a drain electrode of the first switch.

15. The display device according to claim 14, wherein, the LED backlight control circuit further includes multiple display switch modules having the same number as the LED strings, and the display switch modules are disposed between the LED strings and the current modules, wherein, the display switch modules are second switches which are connected in series with the LED strings, and the second switches receive LED-string-switch-control-PWM-dimming signals for controlling turning on and off of the LED strings.

16. The display device according to claim 15, wherein, the LED backlight control circuit further includes a processing module for providing the LED-string-switch-control-PWM-dimming signals to the second switches, and the processing module further provides fixed working voltages to the current modules.

17. The display device according to claim 16, wherein, gate electrodes of the second switches electrically connect to the processing module; source electrodes of the second switches electrically connect to the current modules; drain electrodes of the second switches connect to the negative terminals of the LED strings.

18. The display device according to claim 17, wherein, the current modules are fixed value resistors, and one end of each fixed value resistor connects to the source electrode of the second switch, and the other end of each fixed value resistor connects to the source electrode of the first switch.

19. The display device according to claim 17, wherein, the first switches and the second switches are MOS transistors for dimming.

20. The display device according to claim 12, wherein, the power module includes an inductor and a diode, wherein a positive terminal of the diode connects to the inductor and a negative terminal of the diode connects to positive terminals of the LED strings.

* * * * *